United States Patent [19]

Asano

[11] 4,173,952

[45] * Nov. 13, 1979

[54] CLOSED-LOOP MIXTURE CONTROL SYSTEM FOR AN INTERNAL COMBUSTION ENGINE WITH IMPROVED RESPONSE CHARACTERISTIC TO IDLING CONDITION

[75] Inventor: Masaharu Asano, Yokohama, Japan

[73] Assignee: Nissan Motor Company, Limited, Japan

[ * ] Notice: The portion of the term of this patent subsequent to Jun. 14, 1994, has been disclaimed.

[21] Appl. No.: 873,960

[22] Filed: Jan. 31, 1978

Related U.S. Application Data

[63] Continuation of Ser. No. 678,667, Apr. 20, 1976, abandoned.

[30] Foreign Application Priority Data

Apr. 24, 1975 [JP] Japan ..... 50-49174

[51] Int. Cl.[2] ..... F02B 3/00; F02B 75/10

[52] U.S. Cl. ..... 123/32 EE; 123/119 EC; 60/276; 60/285

[58] Field of Search ..... 123/32 EE, 32 EA, 32 EB, 123/119 EC; 60/276, 285; 261/DIG. 74

[56] References Cited

U.S. PATENT DOCUMENTS

| | | | |
|---|---|---|---|
| 3,831,564 | 8/1974 | Schmidtl et al. | 123/32 EE |
| 3,890,946 | 6/1975 | Wahl | 123/32 EE |
| 3,898,962 | 8/1975 | Wahl et al. | 123/32 EE |
| 3,919,983 | 11/1975 | Honig et al. | 123/32 EE |
| 4,029,061 | 6/1977 | Asano | 60/276 |
| 4,040,394 | 8/1977 | Wahl et al. | 60/285 |
| 4,075,834 | 2/1978 | Saito et al. | 60/285 |

*Primary Examiner*—Charles J. Myhre
*Assistant Examiner*—P. S. Lall
*Attorney, Agent, or Firm*—Robert E. Burns; Emmanuel J. Lobato; Bruce L. Adams

[57] ABSTRACT

A closed-loop control system for an internal combustion engine comprises an exhaust composition sensor, a control unit for generating a control signal in response to the detected exhaust composition to maintain the mixture at a predetermined value, and a sensor for idling condition. The amplitude of the control signal is reduced by a predetermined amount in response to the detected idling condition so that the time required for the mixture to approach the predetermined value is thereby reduced.

3 Claims, 2 Drawing Figures

CLOSED-LOOP MIXTURE CONTROL SYSTEM FOR AN INTERNAL COMBUSTION ENGINE WITH IMPROVED RESPONSE CHARACTERISTIC TO IDLING CONDITION

This is a continuation of application Ser. No. 678,667 now abandoned, filed Apr. 20, 1976.

The present invention relates to mixture control systems, and in particular to a closed-loop mixture control system wherein the operating parameters of the engine indicating the idling condition are detected to vary the magnitude of the control signal derived from an exhaust composition sensor so that the air-fuel ratio is maintained within a narrow range of optimum values.

In prior art closed-loop mixture control systems, the inherent time delay due primarily to the transport time of the air-fuel mixture from injectors to the exhaust composition sensor produces a control signal that varies in large amplitude particularly when the engine is idled, and thus the system will tend to oscillate about a predetermined value of air-fuel ratio.

The primary object of the invention is therefore to provide an improved mixture control system which is free from large amplitude oscillations (hunting) when the engine is under idling condition.

According to the present invention, there is provided an air-fuel mixture control system for an internal combustion engine wherein an exhaust composition of the engine is detected for controlling the air-fuel ratio of the mixture at a predetermined value through a feedback loop, comprising means for detecting the operating parameters of the engine indicating the presence of its idling condition, and means responsive to the detected engine operating parameters to reduce the time required for the mixture to approach said predetermined value of air-fuel ratio.

The idling condition is detected by a throttle switch and an engine speed sensor when the throttle is substantially at the closed position and the engine speed is below a predetermined low speed. An exhaust composition sensor is provided to generate a signal having a characteristic change in amplitude at a predetermined air-fuel ratio or stoichiometry that gives a maximum conversion efficiency for a catalytic converter. A control circuit modifies the sensed exhaust composition signal to form a control signal that maintains the mixture at the predetermined ratio. Under the idling condition, the signal from the idling detector is used to reduce the time required for return to the preset air-fuel ratio.

The invention will be further described by way of example with reference to the accompanying drawings in which.

Figures 1, 2:
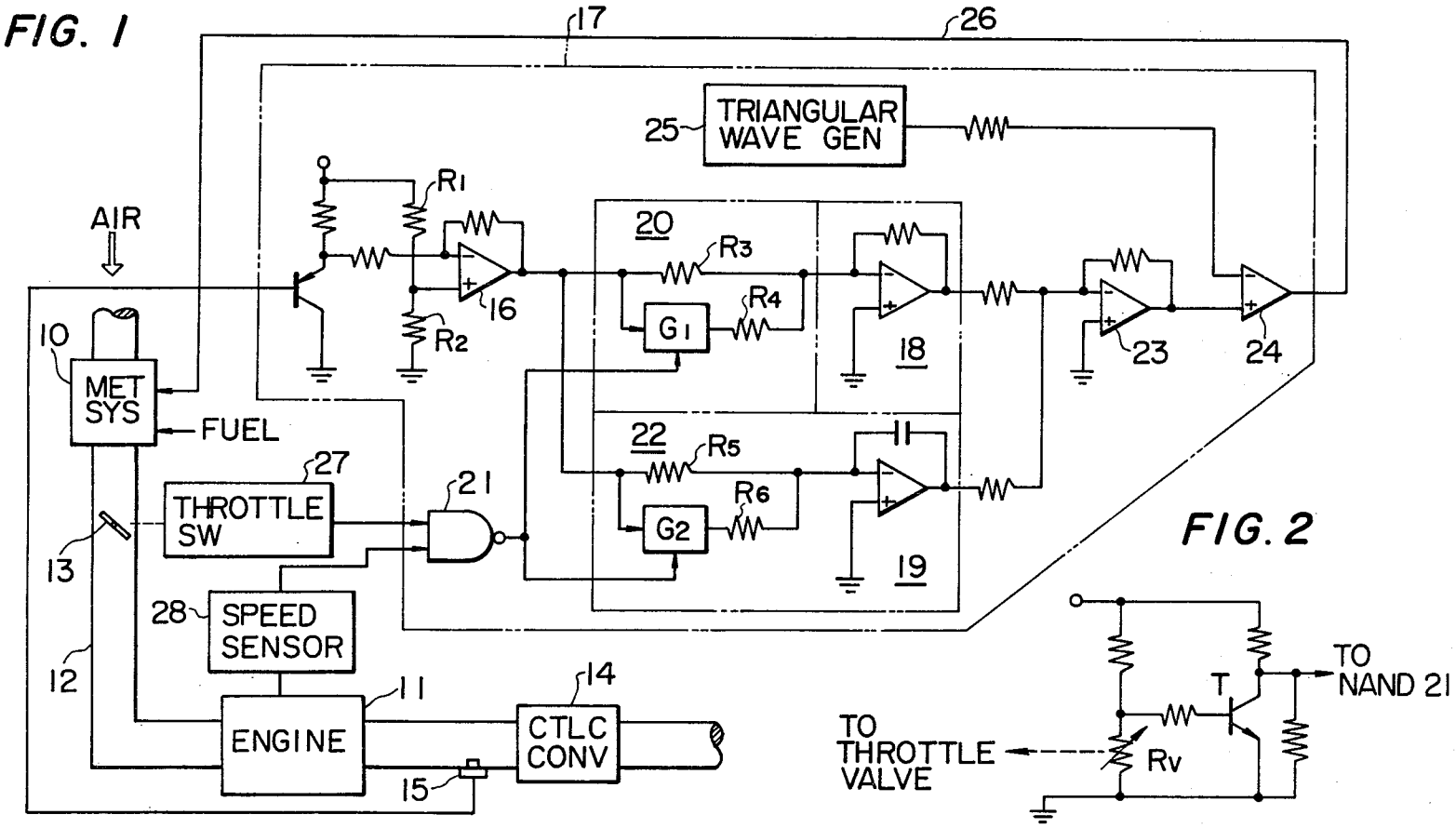
FIG. 1 is a circuit block diagram of an embodiment of the invention.
FIG. 2 is a circuit of a throttle switch employed in the circuit of FIG. 1.

Referring now to FIG. 1, a closed-loop mixture control system in accordance with the invention is shown. A fuel metering system 10 such as a pulse-operated carburetor or an electronic fuel injector supplies air-fuel mixtures to the cylinders of an internal combustion engine 11 through inlet pipe 12 in which a throttle valve 13 is disposed in conventional manner. A catalytic converter 14 of a three-way catalyst type, for example, is provided at the exhaust side of the engine to convert the exhaust emissions to harmless water vapor and carbon dioxide. The three-way catalytic converter operates at a maximum conversion efficiency within a small window of air-fuel ratios, which is usually called "stoichiometric air-fuel ratio". In order to maintain the mixture within the stoichiometric window, an exhaust composition sensor 15 is provided in the exhaust pipe on the upstream side of the catalytic converter 14. This sensor may be a conventionally available zirconium dioxide oxygen sensor which extends into the passage of exhaust gases to provide an output whose amplitude varies at a function of the air-fuel ratio and with a steep transition of about 500 mV at the stoichiometric point. The signal from the oxygen sensor 15 is fed to a comparator or differential amplifier 16 of a control unit 17 for comparison with a predetermined D.C. voltage from a voltage divider circuit $R_1$, $R_2$. The comparator 16 provides a shaped output signal of opposite polarities depending on whether the input signal is above or below the reference point: i.e., positive when the mixture is richer than stoichiometry and negative when leaner than stoichiometry. The control unit 17 has a proportional and an integral response. These response characteristics are achieved by a proportional controller 18 and an integral controller 19.

The output from the comparator 16 is fed to the proportional controller 18 and also to the integral controller 19 through resistor switched networks 20 and 22, respectively. The network 20 is formed by a resistor $R_3$ coupled between the output of comparator 16 and the inverting input of operational amplifier 18, a resistor $R_4$ and a transmission gate $G_1$ or gate-controlled bidirectional conducting device having its transmission path connected in series with resistor $R_4$ and its control gate connected to the output of a NAND gate 21. The output of NAND gate 21 is normally high to turn on gate $G_1$ to bring resistor $R_4$ in parallel circuit with resistor $R_3$ to provide a low resistance path to the inverting input of 18. The switched resistor network 22 is formed in a similar configuration as network 20 to provide a low resistance path to the inverting input of the integral controller 19.

The proportional controller 18 provides an output which varies the fuel quantity proportionally in opposite directions to the sign of comparator 16 output. On the other hand, the integral controller 19 provides an output which varies the fuel quantity linearly in opposite directions to the sign of the comparator signal.

The outputs from both proportional and integral controllers are fed to a summation circuit formed by an operational amplifier 23 which in turn feeds its output to a comparator 24. When the input signal falls below the voltage at the inverting input, the comparator 24 switches on into the output-high state. The signal at the comparator's inverting input is a triangular wave or dither signal supplied from a triangular wave generator 25. The output of comparator 24 goes low when the triangular wave voltage fails below the voltage at the non-inverting input. Therefore, the duration of the output-high state is a function of the signal from the summation circuit 23. The high output voltage is fed back through lead 26 to the metering system 10 to inject fuel to the cylinders of the engine 11.

The air-fuel ratio is thus feedback-controlled at the stoichiometric window under steady cruising conditions.

However, because of the delay time in the system representing the transport time of the air-fuel mixture from the injectors to the oxygen sensor, the control unit 17 keeps influencing the fuel quantity in the same direction even after the reference point has been reached. Control oscillation therefore exists even under steady state conditions of the loop. The oscillation frequency depends primarily on the engine transport delay time. This transport delay in turn depends on the engine speed and the amount of intake air in a manner that increases the delay as these engine parameters take smaller values, particularly under idling state.

Under idling condition, the control system oscillates at a lower frequency with a high amplitude control voltage, which could result in hunting of the control loop.

In accordance with the invention, an idling sensor is provided to detect the occurrence of idling state to hold the fluctuation within a narrow range of amplitudes to prevent hunting of the system. This idling sensor comprises a throttle switch 27 and an engine speed sensor 28. The throttle switch may comprises as shown in FIG. 2 a variable resistor $R_v$ with its control shaft connected to throttle valve 13 for rotation therewith to vary the voltage developed thereacross in accordance with the throttle position. The throttle position representative signal is applied to the base and emitter electrodes of a transistor T, which turns on into the output-low state when the voltage at the base is above a predetermined setting. The output goes high when the base potential falls below the setting as the throttle approaches the fully closed position. The engine speed sensor 28 generates an output when the engine speed falls below a predetermined value. The outputs from these sensors are coupled to the input of NAND gate 21. The NAND gate provides a low level voltage output, when it receives logic 1 on its inputs to disable both transmission gates $G_1$ and $G_2$ to thereby disconnect resistors $R_4$ and $R_6$ from resistors $R_3$ and $R_5$, respectively. Therefore, the input impedance values of both controllers 18 and 19 have increased to reduce the amplitude of control voltage to thereby reduce the time required for return to the reference point.

It is obvious that the amplitude control may be effected also by providing a switched resistor network similar to circuits 20, 22 between the outputs of controllers 18, 19 and the inverting input of the summation amplifier 23.

A conventional carburetor may also be employed. In this case the output from the summation amplifier 23 is used as a drive signal for the analog carburetor.

The foregoing description shows only a preferred embodiment of the present invention. Various modifications are apparent to those skilled in the art without departing from the scope of the present invention which is only limited by the appended claims. Therefore, the embodiment shown in described is only illustrative, not restrictive.

What is claimed is:

1. A mixture control system for internal combustion engines of the type including air-fuel supply means for supplying air and fuel for combustion, and exhaust means for carrying away exhaust gases after combustion, comprising: an exhaust gas sensor for detecting the deviation from a reference value of the concentration of a composition in said exhaust gases determined by said air-fuel supply means; means for generating a control signal varying proportionally to the magnitude of the deviation of said concentration from said reference value in a direction opposite to the direction of said deviation and for controlling said air-fuel supply means so that the ratio of air to fuel is controlled at a predetermined value; means for detecting an operating parameter of the engine indicative of an idling condition; and a switched resistor network providing a variable resistance value which increases in response to the detection of said operating parameter of the engine, said network being connected between the output of said comparator and the input to said control signal generating means to thereby reduce the amplitude of said control signal in response to the detection of an idling condition, whereby the time taken for air and fuel supplied to said engine to approach said predetermined value of air to fuel ratio is reduced.

2. A mixture control system for an internal combustion engine comprising:

an oxygen gas sensor provided in an exhaust system of an internal combustion engine for generating an signal representative of the concentration of oxygen in said exhaust system;

a comparator receptive of the signal representative of said concentration of oxygen for comparing with a reference value representing a predetermined air-fuel ratio to generate an output signal at one of first and second binary levels in dependence upon whether the air-fuel ratio within said exhaust system is above or below the predetermined air-fuel ratio respectively;

means for detecting an operating parameter of the engine indicating the presence of an idling condition;

an integral controller providing integration of the output signal from said comparator; and a switched resistor network providing a variable resistance value which increases in response to the detection of said engine parameter, said resistor network being connected between the output of said comparator and the input to said integral controller and effective to reduce the rate of integration of said integral controller in response to the detection of an idling condition, whereby the time taken for the air and fuel supplied to said engine to approach said predetermined air-fuel ratio is reduced.

3. A mixture control system as claimed in claim 2, including a proportional controller connected in parallel with said integral controller and a second switched resistor network providing a variable resistance value which increases in response to the detection of said engine operating parameter, said second switched resistor network being connected between the output of said comparator and the input of said proportional controller to thereby reduce the amplitude of the output of said proportional controller in response to the detection of an idling condition.

* * * * *